United States Patent [19]

Luke et al.

[11] Patent Number: 4,754,766

[45] Date of Patent: Jul. 5, 1988

[54] TOBACCO SMOKE FILTERS

[75] Inventors: John A. Luke, Eastleigh; James W. Phelpstead, Southampton, both of England

[73] Assignee: British-American Tobacco Company Limited, London, England

[21] Appl. No.: 884,042

[22] Filed: Jul. 10, 1986

[30] Foreign Application Priority Data

Jul. 20, 1985 [GB] United Kingdom ..... 8518385

[51] Int. Cl.[4] ..... A24D 3/04

[52] U.S. Cl. ..... 131/339; 131/340; 131/344

[58] Field of Search ..... 131/336, 337, 338–341, 131/344

[56] References Cited

U.S. PATENT DOCUMENTS

| | | | |
|---|---|---|---|
| 3,800,805 | 4/1974 | Horsewell et al. | 131/338 |
| 3,916,914 | 11/1975 | Brooks et al. | 131/336 |
| 4,380,241 | 4/1983 | Horsewell | 131/340 |
| 4,474,192 | 10/1984 | MacLean et al. | 131/336 |

*Primary Examiner*—V. Millin

*Attorney, Agent, or Firm*—Kane, Dalsimer, Sullivan, Kurucz, Levy, Eisele and Richard

[57] ABSTRACT

A tobacco smoke filtration element having a first smoke-flow passage of filtration efficiency less than that of a second smoke-flow passage, the first smoke-flow passage being provided with a heat deformable material which, upon smoking of a smoking article incorporating such a filtration element, deforms and thereby obturates the first smoke-flow passage causing smoke to pass along the second smoke-flow passage and thereby to be subjected to a higher degree of smoke filtration after the first stages of the smoking cycle.

15 Claims, 2 Drawing Sheets

TOBACCO SMOKE FILTERS

This invention relates to tobacco smoke filters for use in smoking articles, cigarettes for example.

When a filter tipped cigarette is smoked, the mainstream smoke is initially subjected to a filtration effect by the tobacco rod as well as being subsequently subjected to the filtration effect of the filter. Over the first few puffs the tobacco rod length available for filtration, i.e. that portion which is yet to be consumed by the coal, is comparatively large and thus the total filtration effect is high. This contributes to a comparatively low total particulate matter (TPM) delivery of the mainstream smoke over the first few puffs. For some smokers the low TPM content of the mainstream smoke detracts from the satisfaction received from the first few puffs.

In United Kingdom Patent Specification No. 1 428 018 there are disclosed filter tipped cigarettes the filters of which comprise a plug of filtration material and a bypass channel extending from the upstream end of the plug. During the smoking of these cigarettes smoke initially passes down the by-pass channel and at the downstream end of the channel passes into the plug of filtration material through an orifice which is formed in the otherwise smoke impervious wall of the channel. As the distance from the orifice to the mouth end of the plug is short, during the first few puffs the smoke is subjected to only a small degree of filtration in the filter tip. However, as smoking proceeds further, the orifice becomes blocked by the accumulation of particulate material of the smoke. The smoke is thereafter constrained to flow throughout the full length of the filter plug and is therefore subjected to a higher degree of filtration by the filter tip. Thus filters of this type adjust in filtration effect so as to compensate for the initially high but thereafter decreasing filtration effect of the tobacco rod. The achievement of a desired TPM delivery profile by means of this mechanism is though dependent upon accurate dimensioning of the orifice, a requirement which is difficult to meet at the high speeds at which filter tips are required to be made.

Another approach to presenting the cigarette smoker with mainstream smoke which is not over filtered during the first few puffs is disclosed in European Patent Specification No. 077 123. A filter tipped cigarette comprises an axially disposed tube of hydroxypropyl cellulose or other heat fusible material. The tube extends from a location close to, but spaced from, the end of the tobacco rod to be lit to a location intermediate the ends of the filter tip. When the cigarette is smoked, smoke passes during the first few puffs down the length of the tube and then through part only of the length of the filter tip. As the coal nears the tube, the tube is fused to a closed condition by the heat of the coal. Thereafter the smoke passes down the unconsumed portion of the tobacco rod and then through the full length of the filter tip.

Canadian Patent Specification No. 646,959 discloses a filter tipped cigarette the filter tip of which comprises a plug of filtration material and an axially disposed tube which extends from end-to-end of the tip. The inner surface of the tube is coated with a self-sealing adhesive. When the cigarette is smoked, the smoker may choose to permit smoke to pass down the tube in the filter tip or he may squeeze the tip in order to close the tube. Because of the presence of the adhesive, the tube once closed, remains closed. Thereafter the smoke is constrained to flow wholly through the filtration material.

It is an object of the present invention to provide a tobacco smoke filtration element which, when incorporated in a smoking article, effects a comparatively low level of smoke filtration during the first few puffs and a higher level of smoke filtration during subsequent puffs, the change from lower to higher filtration level occurring without manipulation by the smoker. It is a further object to provide such a filtration element which is of a construction susceptible of ready and consistent manufacture at high production speeds.

The present invention provides a tobacco smoke filtration element comprising a first smoke-flow passage and a second smoke-flow passage co-extensive with said first passage, the smoke filtration efficiency of said first passage being less than that of said second passage and said first passage being provided with heat deformable material which deforms and thereby obturates said first passage upon contact with hot tobacco smoke.

The heat deformable material may be such as to expand, contract or change configuration upon being heated. It must, of course, be heat deformable at a temperature not exceeding that at which tobacco smoke is supplied from a smoke article.

The obturation of the first smoke-flow passage brought about by the deformation of the heat deformable material may in some filtration element designs according to the present invention be less than a total obturation.

The heat deformable material may be in sheet form, in which case it may be configured as a tube and thus serve to define the first smoke-flow passage. Alternatively the heat deformable material may be in fibrous form, bicomponent fibrous form for example.

Suitably fibrous filtration material is disposed in the second passage. When the heat deformable material takes the form of a heat collapsable tube, such fibrous material in the second passage is preferably in an expansile condition, as for example by being untreated with plasticiser or other hardener, whereby upon heat collapse of the tube, the fibrous material expands to fill the space vacated by the collapsed tube.

When a filtration element according to the present invention is attached to a rod of smoking material to provide a cigarette or other smoking article, there may be provided in the rod a bore or tube which extends through the tobacco or other smoking material of the rod to the region of the juncture of the rod and the filter element. During the smoking of such a smoking article hot smoke is conveyed through the bore or tube into contact with the heat deformable material.

In order that the invention may be clearly understood and readily carried into effect, reference will now be made, by way of example, to the accompanying diagrammatic drawings, in which.

Figure 1:
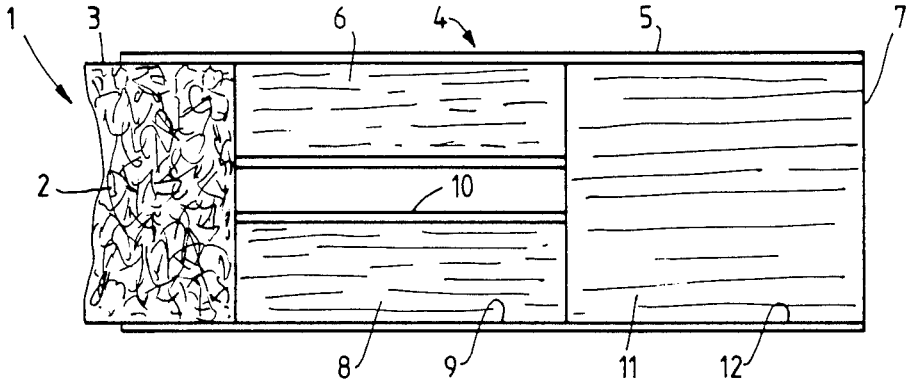
FIG. 1 shows, in axial section, parts of a filter tipped cigarette.
Figure 2:
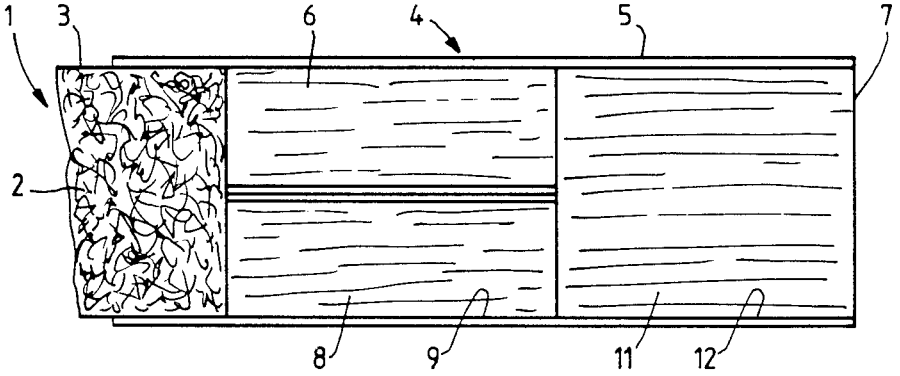
FIG. 2 shows a corresponding view of a similar cigarette which has been smoked over more than the first few puffs.

The cigarettes shown in FIGS. 1 and 2 comprise a tobacco rod 1 of tobacco filler 2 wrapped in cigarette paper 3, which rod 1 and a filter, generally designated by reference numeral 4, are interattached by a tipping wrapper 5.

The filter 4 comprises a first element 6 which is of cylindrical peripheral conformation and is abutted with the tobacco rod 1. In abutment with the first element 6 is a second element 7 of the filter 4.

The element 6 comprises a body 8 of fibrous cellulose acetate wrapped in plugwrap 9. Although it is normal practice to apply a plasticiser to cellulose acetate during the manufacture of cellulose acetate filter rod, the cellulose acetate of the body 8 is unplasticised. The reason for this will become apparent hereinafter.

Disposed co-axially of the element 6, and being surrounded by the body 8 of cellulose acetate, is a tube 10 of heat-shrink material which extends from end-to-end of the element 6 (see FIG. 1). The tube 10 provides a first smoke-flow passage and the surrounding body 8 of fibrous cellulose acetate provides a second smoke-flow passage.

The element 7 comprises a plug 11 of plasticised fibrous cellulose acetate wrapped in plugwrap 12.

During the smoking of the cigarette of FIG. 1 the majority of the tobacco smoke flowing from the tobacco rod 1 to the element 6 of filter 4 initially flows through the tube 10 before entering the element 7. In that the TPM removed from the smoke during its passage through the tube 10 is virtually zero, during the initial phase, i.e. the first few puffs, of the smoking of the cigarette the TPM filtration effect of the filter 4 is that provided by the plug 11 of the element 7 plus that of the body 8 of the element 6. However, very little TPM is removed from the smoke in the body 8 during the initial smoking phase because the tube 10 provides a preferential, low pressure drop path through the element 6 and therefore only a very small proportion of the smoke passes through the body 8.

It will thus be appreciated that during the initial smoking phase the tobacco smoke is subjected to three filtration effects, namely that of the comparatively long unconsumed portion of the filler 2, that of the body 8 of the element 6 and that of the plug 11 of the element 7, but that the second of these filtration effects is very small or even negligible.

At the conclusion of the initial smoking phase the heat of the smoke causes the heat-shrink material of the tube 10 to shrink and, in shrinking, to produce a collapse of the tube 10. Because of the lack of plasticiser in the body 8 of cellulose acetate fibres, the body 8 expands radially inwardly to fill the space vacated by the collapsed tube. This condition is depicted in FIG. 2, in which the collapsed material of the original tube 10 is designated 10'.

Once the tube 10 has collapsed the first smokeflow passage is, of course, no longer available for the passage of smoke through the element 6 and all of the smoke passes through the body 8 of cellulose acetate fibres. Thus at the conclusion of the initial smoking phase the TPM filtration effect of the element 6 is enhanced, in automatic fashion, by a significant amount.

In the filler 14 of the rod 13 there is a bore or tube 23 which extends through the tobacco.

The heat-shrink material of the tube 10 may be, for example, a polyester, a polypropylene, a polyethylene, or a polyvinyl chloride. It should preferably be heat responsive at a temperature in a range of 60° C. to 100° C.

Figure 3:
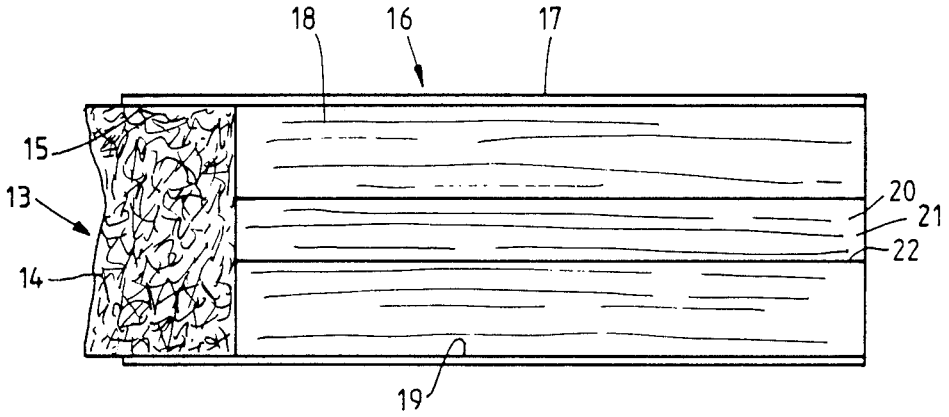
FIG. 3 shows, in axial section, parts of another filter tipped cigarette.
Figure 4:
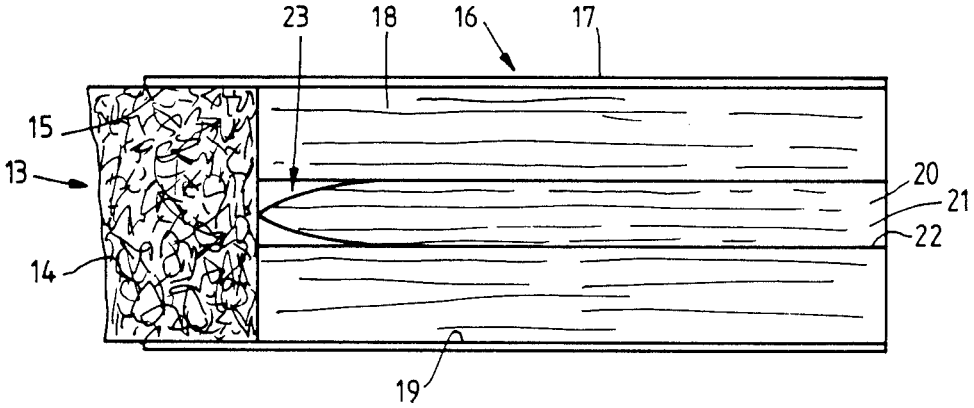
FIG. 4 shows a view coresponding to that of FIG. 3 of a similar cigarette which has been smoked over more than the first few puffs.

The cigarettes shown in FIGS. 3 and 4 comprise a tobacco rod 13 of filler 14 wrapped in cigarette paper 15. The rod 13 and a filter, generally designated by reference numeral 16, are interattached by a tipping wrapper 17 such that the open end of the bore or tube 23 is adjacent the filter 16.

The filter 16 comprises a body 18 of plasticised, fibrous cellulose acetate wrapped in plugwrap 19. Disposed co-axially of the element 16, and being surrounded by the body 18 of plasticised cellulose acetate, is a core element 20 which is of cylindrical form and which extends from end-to-end of the filter 16. The element 20 comprises a tube 22 of the heat-shrink material, but the interior of the tube 22, instead of being empty, contains a body 21 of low density, low pressure drop fibrous filtration material. Because of the low pressure drop of the body 21, the majority of the hot tobacco smoke conveyed directly through the bore or tube 23 into contact with the heat deformable material of the tube 22 initially flows through the body 21. In that the TPM filtration efficiency of the element 20 is low, little TPM is removed from the smoke during its passage therethrough the.

At the conclusion of the initial smoking phase the heat of the smoke causes the tube 22 to shrink. After the heat-shrink material has shrunk as shown in FIG. 4, all of the smoke passes through the body 18, the removal of TPM from the smoke being enhanced. of the The tobacco rod depicted in FIGS. 3 and 4 may also be of conventional construction, likewise the tobacco rod of FIGS. 1 and 2 may be provided with a tube or bore extending through the tobacco or substantially to the rod/filter juncture.

The filtration element of FIGS. 3 and 4 can be modified by the provision of heat-shrink sheet material enwrapping the cylindrical boundary of the body 21.

Although as above described, the filtration elements in accordance with the present invention comprise a single first smoke-flow passage, filtration elements in accordance with the present invention can comprise a plurality of such passages, each being provided with heat deformable passage obturating material.

What is claimed is:

1. A tobacco smoke filtration element comprising a first smoke-flow-through passage and a second smoke-flow passage co-extensive with and surrounding said first passage, the smoke filtration efficiency of said first passage being less than that of said second passage and said first passage being provided with heat deformable material which deforms and thereby only obturates said first passage upon contact with hot tobacco smoke.

2. An element as claimed in claim 1, wherein said heat deformable material is in the form of a tube.

3. An element as claimed in claim 1, wherein said first passage comprises fibrous filtration material.

4. An element as claimed in claim 1, wherein said heat deformable material is in fibrous form and is disposed within said first passage.

5. An element as claimed in claim 1, wherein said first passage extends coaxially of said element.

6. An element as claimed in claim 1, wherein said second passage surrounds said first passage.

7. An element as claimed in claim 1, wherein said second passage comprises fibrous filtration material.

8. An element as claimed in claim 7, wherein said filtration material is an expansile material.

9. An element as claimed in claim 7, wherein said filtration material is cellulose acetate.

10. An element as claimed in claim 1, wherein said heat deformable material is a polyester, a polypropylene, a polyethylene or a polyvinyl chloride.

11. An element as claimed in claim 1, wherein said heat deformable material is responsive at a temperature in the range of 60° C. to 100° C.

12. A smoking article comprising a filter element according to any one of the preceding claims and a smoking material rod interattached by a tipping wrapper.

13. A smoking article as claimed in claim 12, wherein said rod is provided with a bore or tube extending within the smoking material longitudinally of the rod at a downstream region thereof.

14. A smoking article as claimed in claim 12, wherein, disposed in or adjacent of said element is an encapsulated substance capable of reacting exothermically with the moisture of smoke generated by the rod when smoked.

15. A smoking article as claimed in claim 12, and further comprising a plug of filtration material disposed downstream of the element.

* * * * *

UNITED STATES PATENT AND TRADEMARK OFFICE

CERTIFICATE OF CORRECTION

PATENT NO. : 4,754,766

DATED : July 5, 1988

INVENTOR(S) : John A. Luke, et al

It is certified that error appears in the above—identified patent and that said Letters Patent is hereby corrected as shown below:

Col. 2, line 25; - "smoke" should read -- smoking -- .

Col. 3, lines 62 and 63; lines 62 and 63 should be removed from Col. 3, and inserted in Col. 4, line 3 after the numeral 15 at the beginning of the line.

Col. 4, line 23; after the word "therethrough" insert a period and delete the word "the".

Col. 4, line 28; after the period delete the words "of the".

Signed and Sealed this

Twenty-seventh Day of December, 1988

*Attest:*

DONALD J. QUIGG

*Attesting Officer*

*Commissioner of Patents and Trademarks*